US010096935B2

(12) United States Patent
McLemore et al.

(10) Patent No.: US 10,096,935 B2
(45) Date of Patent: Oct. 9, 2018

(54) ELECTRICAL CONNECTOR ADAPTED FOR PORTABLE POWER DISTRIBUTION SYSTEMS

(71) Applicants: Ilsco Corporation, Cincinnati, OH (US); Power Temp Systems, Inc., Houston, TX (US)

(72) Inventors: Michael Kent McLemore, Panorama Village, TX (US); Thomas H. Quinn, Jr., Cincinnati, OH (US); Thomas M. Sweeney, Cincinnati, OH (US)

(73) Assignee: Power Temp Systems, Inc., Houston, TX (US)

( * ) Notice: Subject to any disclaimer, the term of this patent is extended or adjusted under 35 U.S.C. 154(b) by 0 days.

(21) Appl. No.: 15/637,229

(22) Filed: Jun. 29, 2017

(65) Prior Publication Data

US 2018/0006399 A1 Jan. 4, 2018

Related U.S. Application Data

(60) Provisional application No. 62/356,803, filed on Jun. 30, 2016.

(51) Int. Cl.

| | |
|---|---|
| ***H01R 13/621*** | (2006.01) |
| ***H01R 25/16*** | (2006.01) |
| ***H01R 4/36*** | (2006.01) |
| ***H01R 25/14*** | (2006.01) |
| ***H01R 13/193*** | (2006.01) |
| ***H01R 13/207*** | (2006.01) |
| ***H01R 11/07*** | (2006.01) |

(52) U.S. Cl.

CPC ..... *H01R 13/621* (2013.01); *H01R 4/36* (2013.01); *H01R 11/07* (2013.01); *H01R 13/193* (2013.01); *H01R 13/207* (2013.01); *H01R 25/145* (2013.01); *H01R 25/162* (2013.01)

(58) Field of Classification Search

CPC .. H01R 13/207; H01R 13/193; H01R 25/162; H01R 13/6215; H01R 13/621; H01R 25/142

USPC ..... 439/810, 94, 121, 811, 812, 813, 814

See application file for complete search history.

(56) References Cited

U.S. PATENT DOCUMENTS 3,374,456 A * 3/1968 Evans ..... H01R 4/32 439/224

4,327,957 A 5/1982 Cooper, Jr. et al.

(Continued)

*Primary Examiner* — Renee S Luebke

*Assistant Examiner* — Paul Baillargeon

(74) *Attorney, Agent, or Firm* — Wood Herron & Evans LLP

(57) ABSTRACT

An electrical connector adapted for portable power distribution systems and other applications in various embodiments includes a versatile lug which may be selectively and repeatedly coupled to a stranded or other conductor and mounted and re-mounted on a bus bar or other mounting surface via a variety of attachment features on the lug. The lug offers numerous ways to attach it to a power bus and is designed for thousands of installations and re-installations each requiring the appropriate torque on the connector rather than a few such installations for which a known connector is designed and rated. The attachment features included in various embodiments of the lug connector allow for horizontal, vertical, side by side and edge clamping among other mounting configurations.

12 Claims, 8 Drawing Sheets

(56) References Cited

U.S. PATENT DOCUMENTS

| | | | | |
|---|---|---|---|---|
| 7,537,467 | B1 * | 5/2009 | Gretz | H01R 4/36 439/108 |
| 7,699,669 | B2 | 4/2010 | Sweeney et al. | |
| 8,152,573 | B2 * | 4/2012 | Bauer | H01R 24/38 439/782 |
| 8,480,414 | B2 * | 7/2013 | Carnevale | H01R 4/36 439/810 |
| 9,698,578 | B1 | 7/2017 | Jackson et al. | |

* cited by examiner

ELECTRICAL CONNECTOR ADAPTED FOR PORTABLE POWER DISTRIBUTION SYSTEMS

This claims the benefit of U.S. Provisional Application Ser. No. 62/356,803, filed Jun. 30, 2016 and hereby incorporated by reference in its entirety.

BACKGROUND OF THE INVENTION

Various operating centers which employ complex electrical and/or electronics equipment have typically been constructed by first erecting a suitable structure for housing the electrical and electronics equipment at the industrial or commercial installation site. After the operating center is erected, the various cabinets, panels and other units which contain the electrical and electronics equipment are transported to the installation site and installed in the operating center. After the various cabinets, panels and other units are mounted properly, they are then inter-wired and interconnected with one another to form a complete set of control system equipment within the operating center. The control system equipment is thereafter tested to determine that all the proper interconnections have been made and that the equipment is operating as desired. Any necessary adjustments or calibrations of the equipment are made at this time.

Construction and other projects require electric power to be distributed to various tools and components. Once normal electric service is provided to a building and the electric wiring for the building is completed, providing electric power for tools and components is simple. But prior to the completion of the buildings' electric wiring and/or prior to the establishment of regular electric service, providing electric power to the construction site is more problematic. Several prior art devices have been developed to provide temporary power to users at a construction site or related location, some examples of which are provided by Power Temp Systems, Inc. out of Houston, Tex., www.powertemp-.com.

During building or repair tasks at construction sites or other workplaces, it is often necessary to provide temporary electrical power for operating many lights, tools or other devices at the same time when permanent power distribution facilities have not yet been installed or are out of service because of damage or equipment failure. In some cases, the temporary power distribution apparatus must be carried through or used in a confined space that does not afford much room for the apparatus.

Systems are known for distributing AC or DC voltage and current to multiple loads from one or more sources on a power bus. The simplest form of such a system is a multiple connector box at the end of an extension power cord. A more complex system is a connector affixed to a printed circuit board via pins extending from the connector into receiving holes in the printed circuit board. Terminal blocks with isolated positive and negative rails from which voltage is carried to appliance loads via insulated multiple strand conductor wire is yet another example of a system for distributing AC or DC power.

Where insulated wire pairs are used, the connections are made by affixing terminals or lugs to the ends of the wires. Some terminal blocks provide studs on which the terminals can be secured using nuts, set screws and/or lock washers. Systems such as these have little or no provision for rapid disassembly or assembly. Electrical connectors and lugs typically employed in such settings are not suited for multiple installations, removals and re-installation.

In systems using terminal blocks, the task of affixing terminals to wires or terminals to the studs is time consuming and subject to defects if proper procedures such as, cleaning or clearing the contacts or studs of dirt, snow, ice, and corrosion followed by operations such as torquing nuts on studs, are not followed. If a technician is connecting a DC service from a lead acid battery or from another low impedance voltage source capable of driving multiple horsepower DC motor loads, or loads such as a heavy-duty arc welder, a mistake made by the technician in connecting the polarity of the electrical service can be catastrophic.

Conventional systems for connecting one or more sources to more than one load include those that have terminal blocks with leads to service the appliance loads, clips and electrical connectors, barrier strips, connectors with pins that preclude polarity errors, terminal blocks with terminal connectors that preclude improper orientation, devices for selectively interconnecting a series of connectors, extension cords, multiple outlet boxes, and power strips. However, none of those systems, either separately or in combination, offer an integrated system and components for rapidly and reliably connecting and disassembling, disconnecting and reconfiguring power to respective loads, and for servicing the power from one or more respective voltage sources. The electrical connectors are not versatile and often require specially designed lugs for proper installation. This often increases required inventory and makes the set-up and removal procedures more difficult.

SUMMARY OF THE INVENTION

These and other shortcomings in the prior art have been addressed by various embodiments of this invention which include an electrical connector adapted for portable power distribution systems and other applications. In various embodiments, this invention includes a versatile lug which may be selectively and repeatedly coupled to a stranded or other conductor and mounted and re-mounted on a bus bar or other mounting surface via a variety of attachment features on the lug. While known standard lugs have provision for a single mounting style, the lug of this invention in various embodiments is more versatile and accommodates a wide range of mounting schemes and configurations. This invention differs from normal connectors due to the numerous ways to attach it to a power bus and the fact that it is designed for thousands of installations and re-installations each requiring the appropriate torque on the connector rather than a few such installations for which a known connector is designed and rated.

The attachment features included in various embodiments of the lug connector of this invention allow for horizontal, vertical, side by side and edge clamping among other mounting configurations. The ability to provide for such versatile mounting schemes and configurations allows for reduced inventory and elimination of specialized and single use electrical connectors which is particularly advantageous when used in a temporary or portable power distribution system. Various embodiments of this invention provide for attachment features on all sides of the lug to land (mount) compression or mechanical connectors. The invention accommodates stud mounted connectors and is designed for mounting provisions for isolated applications. Simultaneous hardwire and multiple eyelet connections are possible with the lug of this invention in various embodiments. A user may tie into the lug and simultaneously bolt to a cable with eyelets.

These and other features and benefits of various embodiments of this invention are realized to address and overcome the identified and other shortcomings of the prior art.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
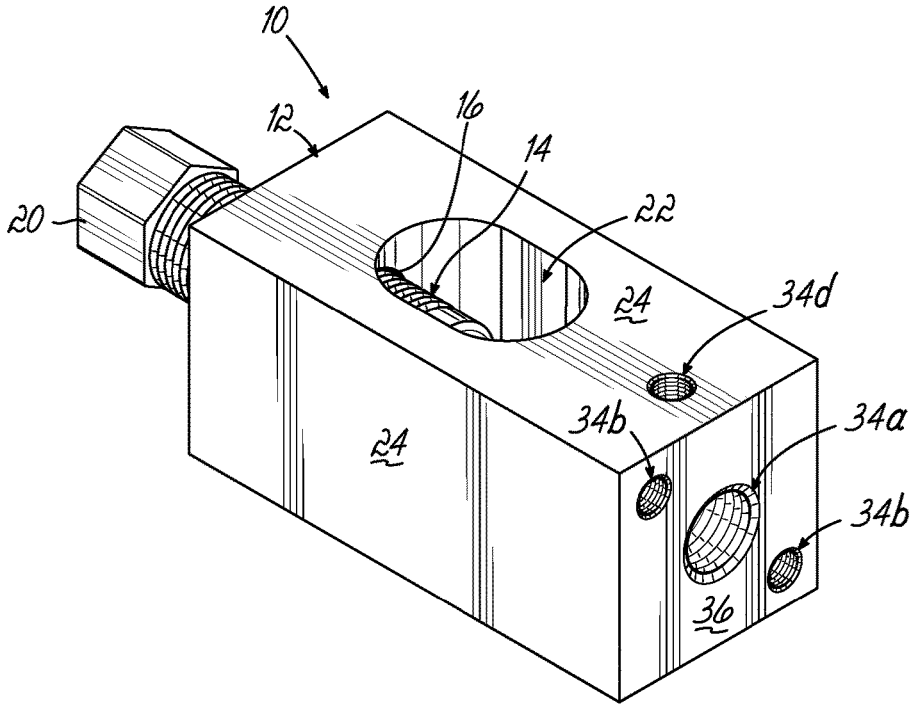
FIG. 1 is a perspective view of one embodiment of an electrical connector lug adapted for various applications including portable power distribution systems according to this invention.
Figure 1A:
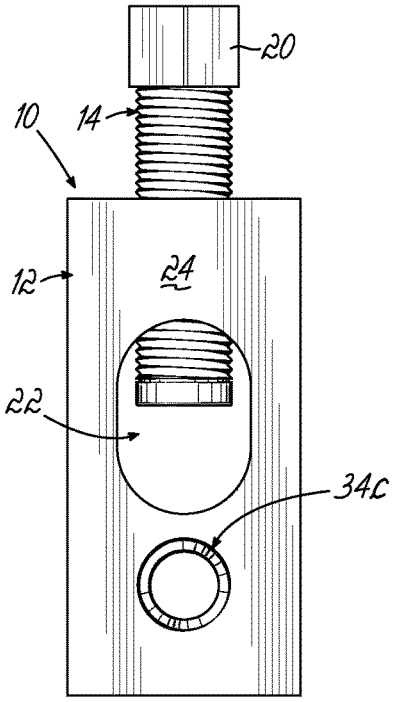
FIGS. 1A-1D are perspective views of alternative embodiments of the lug of FIG. 1 according to this invention.
Figure 1B:
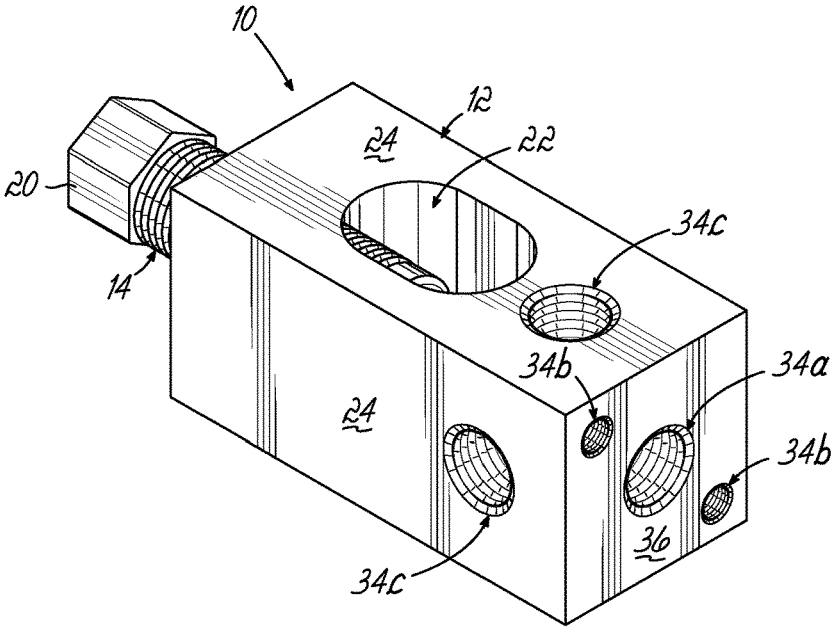
Figure 1D:
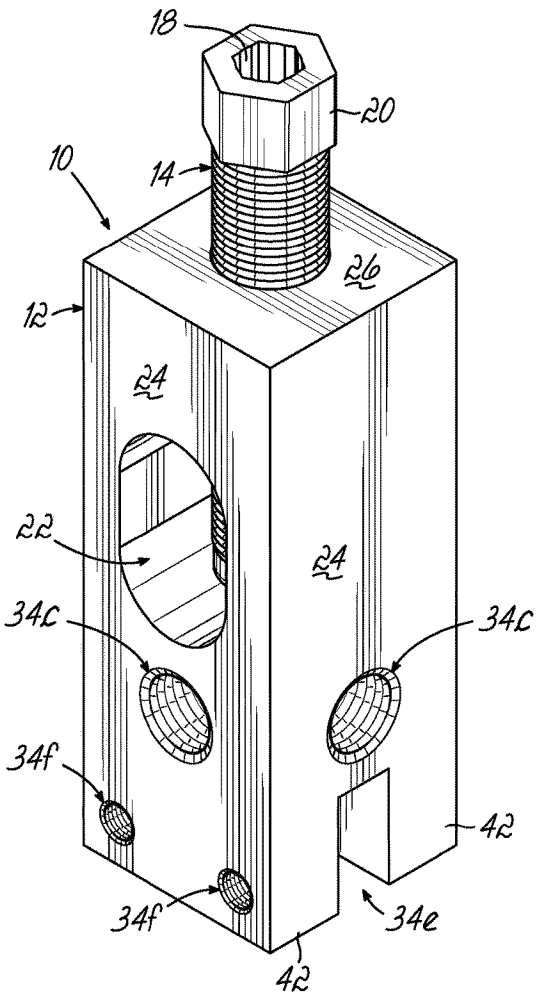

Referring to FIGS. 1-1D, various embodiments of a lug electrical connector 10 according to this invention are shown. The lug 10 includes a metallic terminal lug body 12 which may be copper, aluminum or another suitable material well known to those of ordinary skill in this art. The lug 10 includes a set screw 14 which is received within a threaded set screw bore 16 of the lug 10 oriented generally axially or longitudinally on the lug body 12. The set screw 14 may be a headless set screw having a hexagon-shaped recess 18 or a set screw with a head 20 having a hexagon-shaped recess 18 and an external configuration adapted for use with a wrench or other tool for securing the set screw 14 in the lug body 12. The set screw 14 may be of the type disclosed in U.S. patent application Ser. No. 15/139,416, filed Apr. 27, 2016 or in U.S. Pat. No. 7,699,669 issued Apr. 20, 2010, each of which is hereby incorporated by reference in its entirety.

The lug body 12 of FIGS. 1-1D includes a laterally extending conductor bore hole 22 extending from opposite side faces 24, 24 of the body 12 and generally perpendicular to the set screw bore 16. The set screw 14 is seated within the threaded bore 16 extending longitudinally from an upper face 26 of the body 12 and in communication with the conductor bore 22. The threaded set screw bore 16 extends into the body 12 and the conductor bore 22 and terminates therein.

Figure 2:
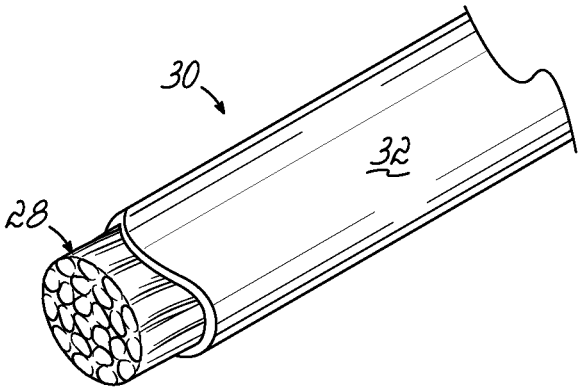
FIG. 2 is a perspective view of a stranded conductor for coupling to the lug according to this invention.

The conductor bore hole 22 is adapted to receive the multiple strands 28 of a conductor 30 as shown in FIG. 2. The conductor 30 includes the multiple strands 28 covered by a sheath 32 which may be removed from the terminal end of the conductor 30 for appropriate electrical connection by the conductor strands 28 with the lug 10.

The lug 10 according to various embodiments of this invention also includes several attachment features 34 in the lug body 12 which are each adapted for connecting the lug 10 to the appropriate compatible equipment providing for electrical connection. One attachment feature 34 is shown in FIGS. 1 and 1B as a threaded bore hole 34*a* extending axially and longitudinally from a bottom face 36 of the lug body 12. This attachment feature 34*a* is adapted to receive a threaded bolt, stud or other mechanical fastener therein for mounting the lug body 12 to a slotted bus bar 38 via an adapter 40 as shown particularly in FIG. 4 or another appropriate mounting arrangement with or without the adapter 40. The fastener 35 which may be used to mate with the attachment feature 34 may take any one of a variety of forms and is generally identified by reference numeral 35 herein. The component to which the lug 10 of various embodiments of this invention is to be mounted will generally be identified by reference numeral 38 and one of ordinary skill in the art will appreciate that such a component 38 may take a wide variety of shapes, configurations and functions and is not a restriction on this invention. One example of such a component 38 is a bus bar as disclosed in U.S. patent application Ser. No. 15/376,762 filed Dec. 13, 2016 and hereby incorporated by reference in its entirety.

In various embodiments, the cross-sectional configuration of the lug body 12 is generally square. Likewise, the top and bottom faces 26, 36 of the lug body 12 are generally square while each side face 24 of the lug body 12 is generally rectangular. Two additional attachment features 34 may also be provided in the bottom face 36 of the lug body 12 which comprise small threaded bore holes 34*b* each of which is adjacent a corner of the bottom face 36 of the lug body 12 and positioned proximate opposite corners of the lug body 12 as shown generally in FIGS. 1 and 1B. These attachment features 34*b* are typically used in combination with one another and are adapted to receive smaller diameter bolts, screws or other mechanical fasteners 35 which are used to mount the lug body 12 in various mounting schemes, some of which are demonstrated in FIGS. 4-6.

Figure 6:
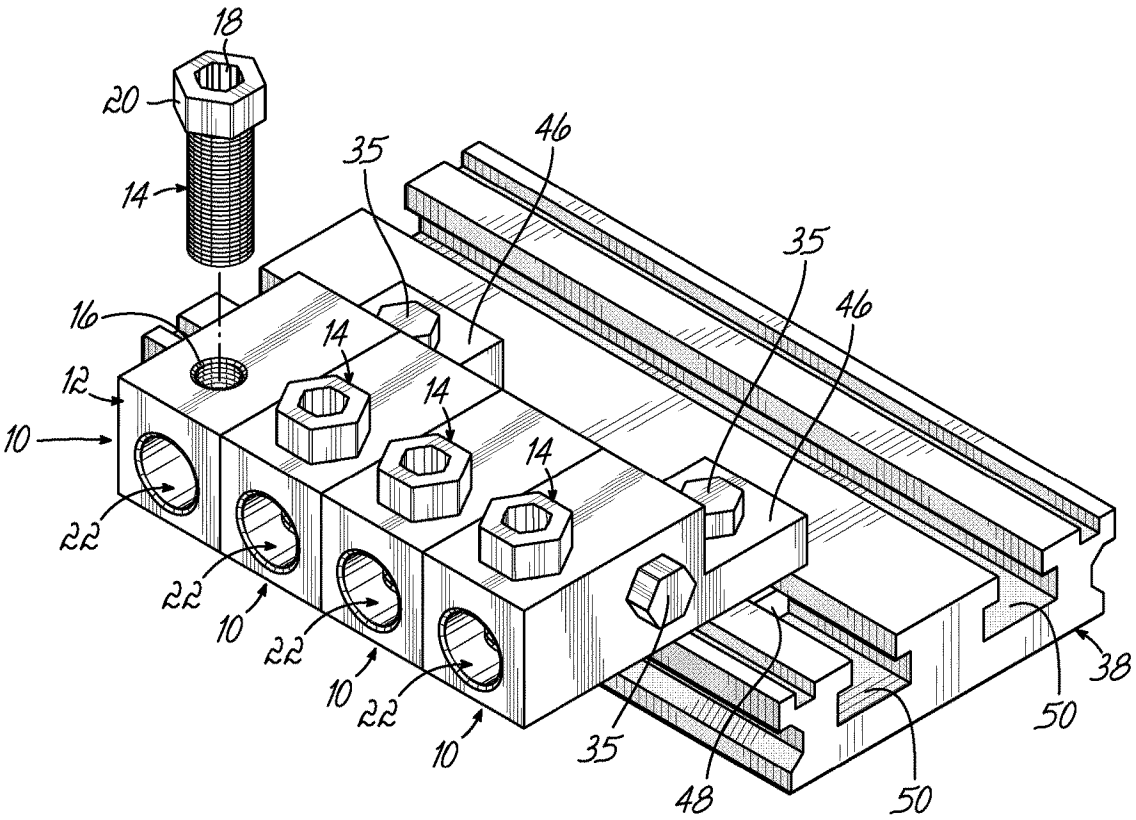
FIG. 6 is a perspective view of an installation using a number of lugs of various embodiments of this invention mounted on a bus bar.

Additional attachment features 34 which are included in various embodiments of the lug 10 according to this invention are shown in FIGS. 1A-1D in the form of threaded (or unthreaded) bore holes 34*c* extending through the lug body 12 from opposite side faces 24 of the lug body 12. These side face lug bore holes 34*c* intersect beneath the conductor bore hole 22 and provide for attachment of a threaded or unthreaded bolt, stud or other mechanical fastener 35 for mounting the lug body 12. While the intersecting threaded bore holes 34*c* extending between opposite side faces 24 of the lug body 12 are shown in FIGS. 1A-1D, one of ordinary skill in the art will appreciate that two such bore holes are not required and only one such bore hole may extend between either pair of the opposite faces 24 of the lug body 12 according to various embodiments of this invention. Moreover, if two such threaded bore holes are provided, they may or may not be of the same thread or diameter specification. For example, a side face threaded bore hole 34*d* is shown in FIG. 1 having a smaller diameter than those of the side face threaded bore holes 34*c* of FIGS. 1A-1D. Moreover, the bore holes 34*c* may be unthreaded and provide for insertion of a bolt or other fastener to mount multiple lugs 10 together as shown in FIG. 6. The lugs 10 as shown in FIG. 6 may or may not include an extending tang 47 for mounting the lug 10 and/or attached lugs 10 to a bus bar 38 or the like.

The lugs 10 of FIG. 6 have the conductor bore hole 22 on a longitudinal end of the lug body 12 and the threaded bore hole 16 in which the set screw 14 is seated on a side face 24 of the lug body 12. The mounting arrangement of FIG. 6 includes four lugs 10, two of which include the tang 47 and two of which do not and any number of lugs 10 may be utilized in a mounting arrangement.

Figure 1C:
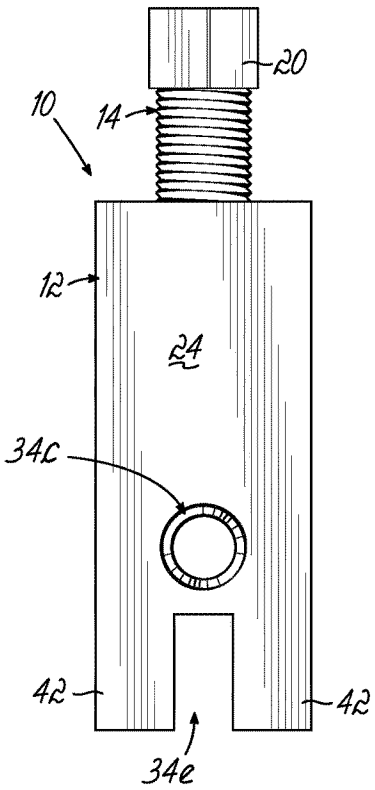
Figure 5A:
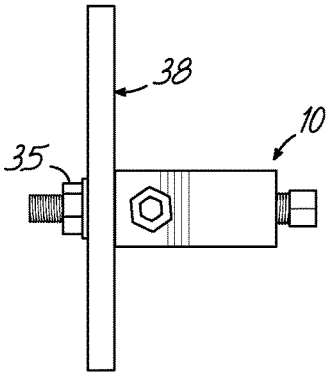
FIGS. 5A-5L are top plan views of various configurations, mounting schemes and installations utilizing the lugs of various embodiments of this invention for electrical connection.
Figure 5B:
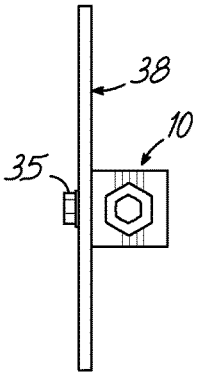
Figure 5C:
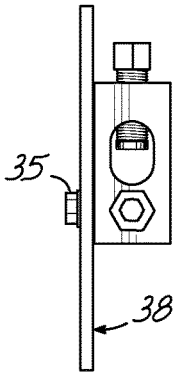
Figure 5D:
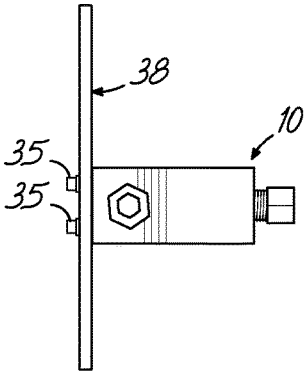
Figure 5E:
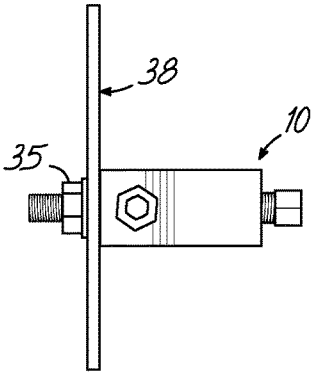
Figure 5F:
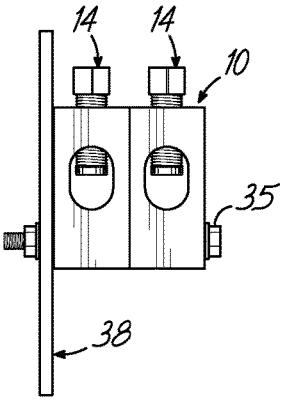
Figure 5G:
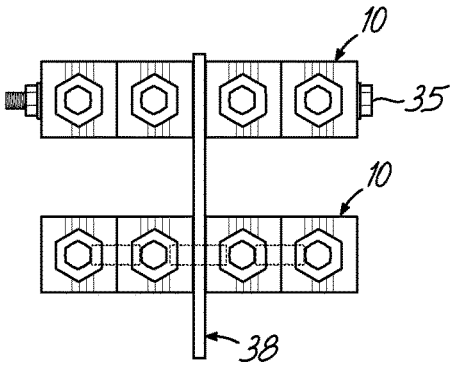
Figure 5H:
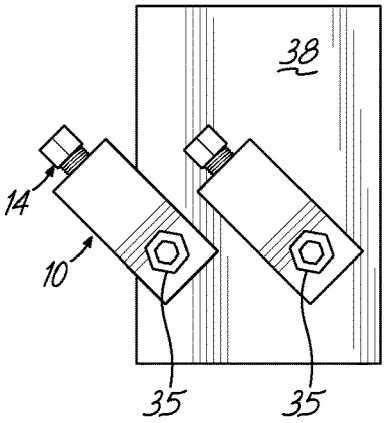
Figure 5I:
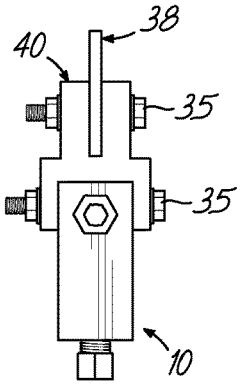
Figure 5J:
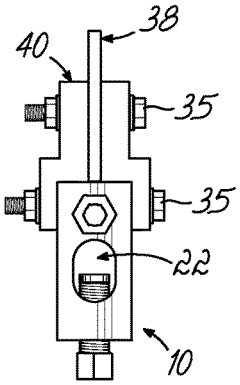
Figure 5K:
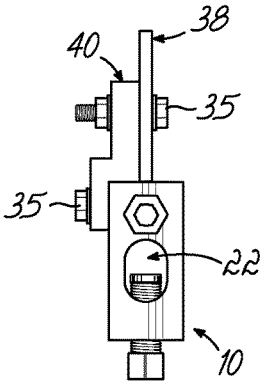
Figure 5L:
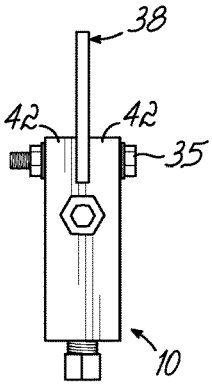

An additional attachment feature 34 which may be provided in various embodiments of the lug 10 according to this invention is a slot 34*e* extending generally perpendicular to the conductor bore hole 22 (FIGS. 1C-1D) or parallel (not shown) and on the bottom face 36 of the lug body 12 as shown in FIGS. 1C-1D. The slot 34*e* bifurcates the lower portion of the lug body 12 into two posts 42 and allows for the lug body 12 to be mounted on a bar 38 as shown in FIG. 5L. The two posts 42 formed on either side of the slot 34*e* may each have additional attachment features 34 including a pair of threaded or unthreaded slot bore holes 34*f* extending into the post 42 as shown in FIG. 1D.

These and other attachment features 34 may be provided with the lug 10 according to various embodiments of this invention in various combinations or individually as is appropriate for the particular mounting requirements. Moreover, each of the attachment features may be threaded or unthreaded as appropriate.

Figure 4:
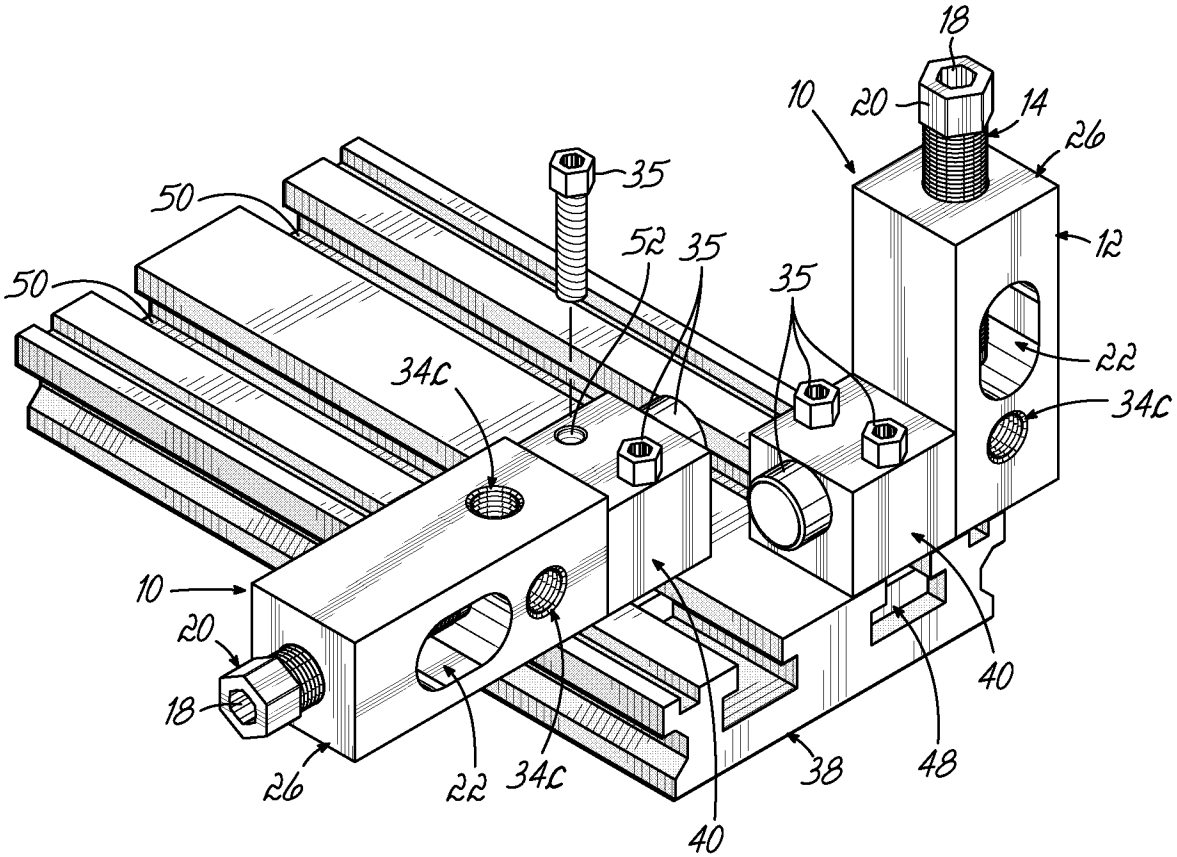
FIG. 4 is a perspective of an exemplary installation utilizing the lug according to various embodiments of this invention connected to a slotted bus bar.

The lug 10 according to this invention may be mounted to the slotted bus bar 38, an example of which is shown in FIGS. 4 and 6, and disclosed in U.S. Pat. No. 9,698,578, issued on Jul. 4, 2017 and hereby incorporated by reference in its entirety. A slot 50 may be utilized for proper mounting of the lug 10 to the slotted bus bar 38.

Figure 3:
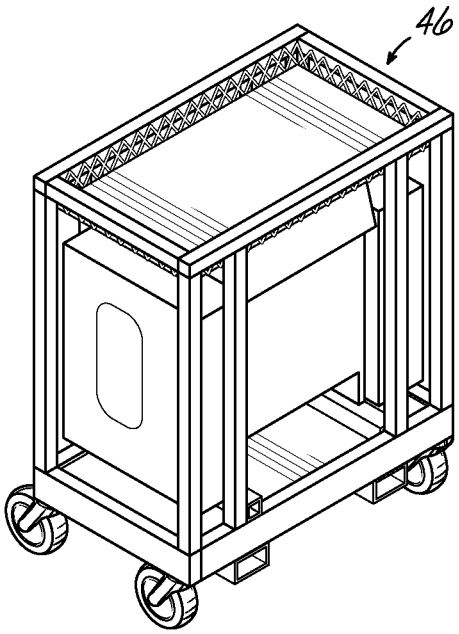
FIG. 3 is a perspective view of an exemplary portable power distribution center in which various embodiments of the lug according to this invention may be utilized.

One application of the lug 10 according to this invention may be for connecting conductors 30 as shown in FIG. 2 to a portable and/or temporary power distribution center 46, one example of which is shown in FIG. 3. However, those of ordinary skill in the art will appreciate that the lug 10 of this invention may be utilized in many other applications in addition to the power distribution center 46 shown in FIG. 3.

Various installation schemes for the lug 10 according to various embodiments of this invention may utilize an adapter 40 to which the lug body 12 is connected for mounting the lug 10 and adapter 40 to a bus bar 38 or the like. The adapter 40 may take any one of a variety of shapes and configurations and may include an extension 48 which is to be seated within a slot 50 of a slotted bus bar 38 as shown, for example, in FIG. 6. The adapter 40 may also include any number, size, arrangement and configuration of threaded or unthreaded bore holes 52 which allow for mounting with the various components as may be required according to a particular installation.

From the above disclosure of the general principles of this invention and the preceding detailed description of at least one embodiment, those skilled in the art will readily comprehend the various modifications to which this invention is susceptible. Therefore, we desire to be limited only by the scope of the following claims and equivalents thereof.

We claim:

1. An electrical lug connector assembly comprising:

a plurality of lug bodies;

a conductor bore hole in each lug body adapted to receive a plurality of strands of a conductor therein;

a threaded set screw bore hole in each lug body and in communication with an associated conductor bore hole;

a plurality of set screws each threadably received in the threaded set screw bore hole of one of the lug bodies for selectively engaging the plurality of strands of the conductor when positioned within the conductor bore hole to thereby make an electrical connection between the electrical lug connector and the conductor; and at least one attachment feature formed in the lug body and adapted to mount the lug body to a compatible component for electrical connection with the compatible component in a variety of configurations;

wherein a first set of the plurality of lug bodies further comprises:

a plurality of tangs, each of the plurality of tangs projecting from one of the lug bodies of the first set of the plurality of lug bodies;

wherein the at least one attachment feature of each of the plurality of lug bodies of the first set further comprises a first attachment feature on an associated tang to mount the lug body to the compatible component;

wherein the plurality of lug bodies is each similarly oriented and serially juxtaposed adjacent to one another;

wherein the at least one attachment feature of each of the lug bodies of the first set further comprises a second attachment feature comprising a hole through the lug body; and a fastener extending through the second attachment feature of each of the lug bodies and thereby coupling at least two of the lug bodies together.

2. The assembly of claim 1 further comprising a plurality of the attachment features.

3. The assembly of claim 2 wherein the lug body has a bottom face and a plurality of side faces and the plurality of attachment features are provided on separate faces of the lug body.

4. The assembly of claim 1 further comprising:

an adapter for mounting the lug body to the compatible component.

5. The assembly of claim 1 wherein the compatible component is one of a power distribution center and a bus bar.

6. The assembly of claim 1 wherein the attachment feature further comprises:

one of a threaded bore hole and an unthreaded bore hole.

7. The assembly of claim 1 wherein the attachment feature further comprises:

a slot in the lug body.

8. An electrical lug connector assembly comprising:

a plurality of lug bodies;

wherein each of the plurality of lug bodies further comprises:

a bottom face and a plurality of side faces;

a conductor bore hole adapted to receive a plurality of strands of a conductor therein;

a threaded set screw bore hole in the lug body and in communication with the conductor bore hole;

a set screw threadably received in the threaded set screw bore hole for selectively engaging the plurality of strands of the conductor when positioned within the conductor bore hole to thereby make an electrical connection between the electrical lug connector and the conductor; and a plurality of attachment features each formed in the lug body and adapted to mount the lug body to a compatible component for electrical connection with the compatible component in a variety of configurations, wherein the plurality of attachment features are on separate faces of the lug body;

wherein a first set of the plurality of lug bodies further comprises:

a tang projecting from an associated lug body;

wherein a first one of the plurality of attachment features is on the tang to mount the lug body to the compatible component;

wherein the plurality of lug bodies is each similarly oriented and serially juxtaposed adjacent to one another;

wherein a second attachment feature of the plurality of attachment features is on each of the lug bodies and further comprises a hole through the lug body; and a fastener extending through the second attachment feature of each of the lug bodies and thereby coupling at least two of the lug bodies together.

9. The assembly of claim 8 further comprising:

an adapter for mounting the lug body to the compatible component.

10. The assembly of claim 8 wherein the compatible component is one of a power distribution center and a bus bar.

11. The assembly of claim 8 wherein at least one of the plurality of attachment features further comprises:

one of a threaded bore hole and an unthreaded bore hole.

12. The assembly of claim 8 wherein at least one of the plurality of attachment features further comprises:

a slot in the lug body.

* * * * *